United States Patent [19]

Bianca et al.

[11] Patent Number: 4,715,301

[45] Date of Patent: Dec. 29, 1987

[54] LOW EXCESS AIR TANGENTIAL FIRING SYSTEM

[75] Inventors: Joseph D. Bianca, Feeding Hills; David K. Anderson, East Longmeadow, both of Mass.

[73] Assignee: Combustion Engineering, Inc., Windsor, Conn.

[21] Appl. No.: 26,223

[22] Filed: Mar. 16, 1987

Related U.S. Application Data

[63] Continuation of Ser. No. 843,419, Mar. 24, 1986, abandoned.

[51] Int. Cl.[4] ..... F23D 1/00

[52] U.S. Cl. ..... 110/347; 110/264; 122/449

[58] Field of Search ..... 110/347, 260–265; 122/449

[56] References Cited

U.S. PATENT DOCUMENTS

| | | | |
|---|---|---|---|
| 3,224,419 | 12/1965 | Lowenstein et al. | 110/264 |
| 4,294,178 | 10/1981 | Borio et al. | 110/347 |
| 4,304,196 | 12/1981 | Chadshay et al. | 122/449 |
| 4,434,747 | 3/1984 | Chadshay | 122/449 |
| 4,438,709 | 3/1984 | Borio et al. | 110/347 |
| 4,501,204 | 2/1985 | McCartney et al. | 110/264 |

*Primary Examiner*—Henry C. Yuen

*Attorney, Agent, or Firm*—Arthur E. Fournier, Jr.

[57] ABSTRACT

A furnace (10) in which pulverized coal is burned in suspension. The coal is introduced along with primary air, tangent to an imaginary circle (42). The auxiliary air is introduced tangent to an imaginary circle (44) directly above the primary air, in a direction of rotation opposite that of the primary air. The auxiliary air is directed tangent to a circle of greater diameter than that of the primary air. There are a plurality of alternating levels within the furnace where primary air (38), and then auxiliary air (40), is introduced.

11 Claims, 4 Drawing Figures

LOW EXCESS AIR TANGENTIAL FIRING SYSTEM

This is a continuation of application Ser. No. 843,419, filed Mar. 24, 1986, now abandoned.

BACKGROUND OF THE INVENTION

Pulverized coal has been successfully burned in suspension in furnaces by tangential firing methods for a long time. The technique involves introducing the coal and air into a furnace from the four corners thereof so that it is directed tangent to an imaginary circle in the center of the furnace. This type of firing has many advantages, among them being good mixing of the fuel and air, stable flame conditions, and long residence time of the combustion gases in the furnace. In recent times, it has become important to minimize air pollution as much as possible. Thus, some proposed changes have been made to the standard tangential firing method. One such arrangement is set forth in our pending patent application Ser. No. 786,437, now abandoned, entitled "A Control System and Method for Operating a Tangentially Fired Pulverized Coal Furnace", filed on Oct. 11, 1985. That application proposes introducing pulverized coal and air tangentially into the furnace from a number of lower burner levels in one direction, and introducing coal and air tangentially into the furnace from a number of upper burner levels in the opposite direction. By this arrangement, better mixing of the fuel and air is accomplished, thus permitting the use of less excess air than with a normal tangentially fired furnace, which generally is fired with 20–30% excess air. The reduction in excess air helps minimize the formation of $NO_x$ which is a major air pollutant of coal-fired furnaces. It also results in increased efficiency of the unit. Although the above firing technique reduces $NO_x$, it does have some disadvantages. Since the reverse rotation of the gases in the furnace cancel each other out, the gases flow in a more or less straight line through the upper portion of the furnace, increasing the possibility of unburned carbon particles leaving the furnace due to reduced upper furnace turbulence and mixing. In addition, slag and unburned carbon deposits on the furnace walls can occur. These wall deposits reduce the efficiency of heat transfer to the water-cooled tubes lining the walls, increases the need for soot blowing, and reduces the life span of the tubes.

SUMMARY OF THE INVENTION

In accordance with the invention, a furnace is provided in which pulverized coal in burned is suspension with good mixing of the coal and air, as in the case of the above-mentioned patent application. In addition, all of the advantages previously associated with tangentially fired furnaces are obtained, by having a swirling, rotating, fire ball in the furnace. The walls are protected by a blanket of air, reducing slagging thereof. This is accomplished by introducing coal and primary air into the furnace tangentially at a first level, introducing auxiliary air in an amount at least twice that of the primary air into the furnace tangentially at a second level directly above the first level, but in a direction opposite to that of the primary air, with there being a plurality of such first and second levels, one above the other. As a result of the greater mass and velocity of the auxiliary air, the ultimate swirl within the furnace will be in the direction of the auxiliary air introduction. Because of this, the fuel, which is introduced in a direction counter to the swirl of the furnace, is forced after entering the unit, to change direction to that of the overall furnace gases. Tremendous turbulent mixing between the fuel and air is thus created in this process. This increased mixing reduces the need for high levels of excess air within the furnace. This increased mixing also results in enhanced carbon conversion which improves the units over all heat release rate while at the same time reducing upper furnace slagging and fouling. The auxiliary air is directed at a circle of larger diameter than that of the fuel, thus forming a layer of air adjacent the walls. In addition, overfire air, consisting essentially of all of the excess air supplied to the furnace, is introduced into the furnace at a level considerably above all of the primary and auxiliary air introduction levels, with he overfire air being directed tangentially to an imaginary circle, and in a direction opposite to that of the auxiliary air.

DESCRIPTION OF THE PREFERRED EMBODIMENT

Figure 1:
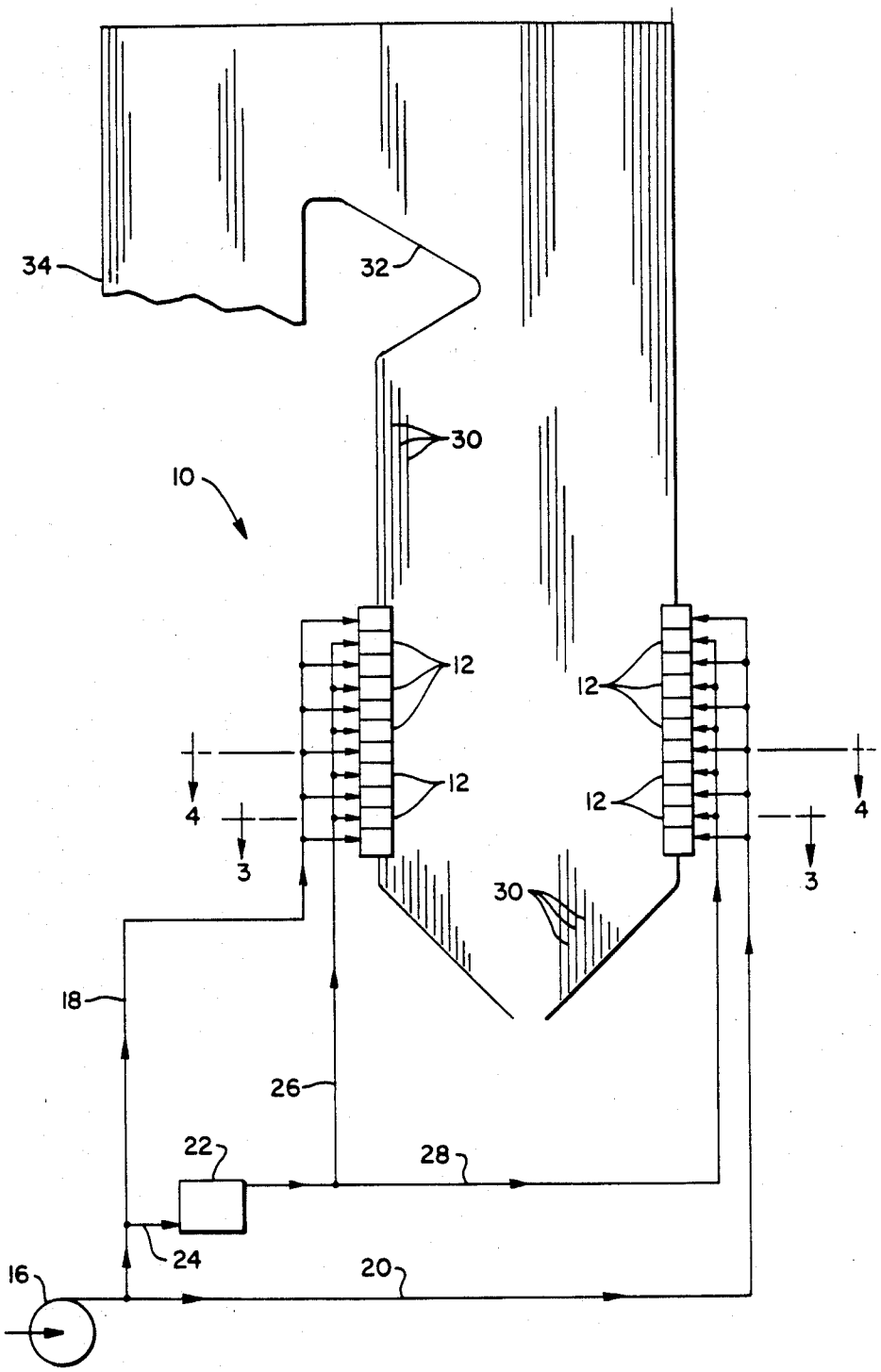
FIG. 1 is a sectioned perspective of a tangentially fired pulverized coal furnace incorporating the invention.

Looking now to FIG. 1, a coal-fired furnace 10 is shown, having a plurality of levels of burners 12 therein with each level having a burner mounted in each of the four corners thereof. Air is supplied to pulverizer 22 through ducts 18 and 20. Air is also supplied to pulverizer 22 through duct 24. Pulverized coal is transported to the burners in an air stream through ducts 26 and 28. There are separate air and fuel ducts leading to each individual burner, with separate valves and controls (not shown) also, so that each burner can be independently controlled. The combustion gases swirling upwardly in the furnace give up heat to the fluid passing through the tubes 30 lining all four of the furnace walls, before exiting th furnace through horizontal pass 32, leading to rear gas pass 34. Both the furnace and the rear pass contain other heat exchanger surface (not shown), for generating and super heating steam, as well known in the art.

Figure 2:
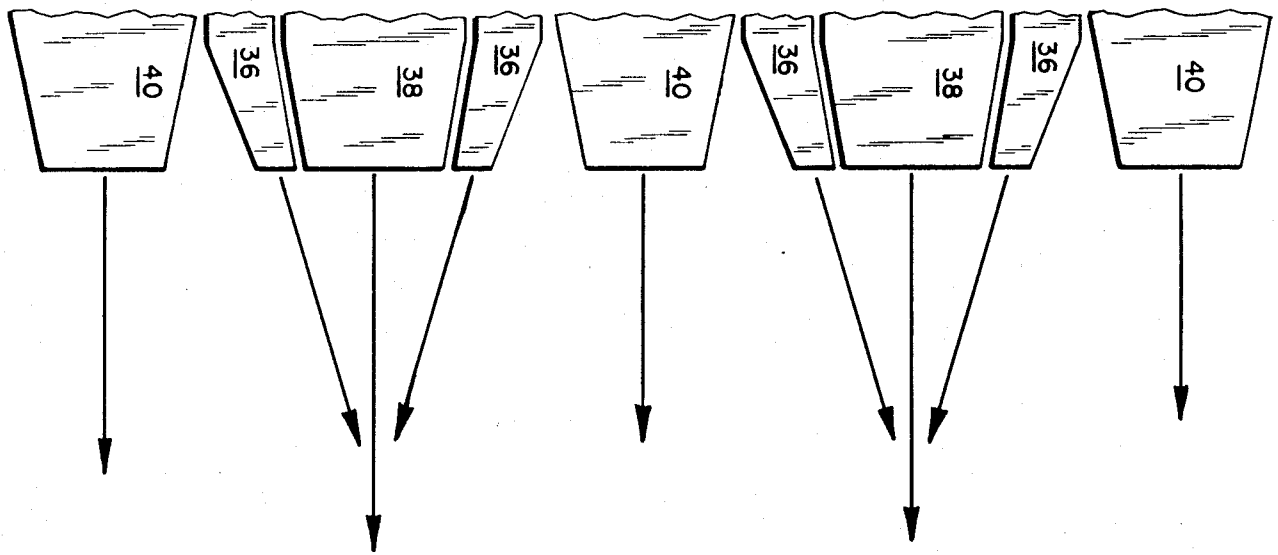
FIG. 2 is an enlarged sectional view of one corner of burners.

The specific manner of introducing the fuel and air into the furnace will now be described in more detail. Pulverized coal, generally ground to a flour-like consistency, is carried to each burner in a stream of air from the pulverizer mill 22. This air that carried the coal is generally referred to as the primary air. As best seen in FIG. 2, more air, generally designated as secondary air, is introduced directly above and below the fuel nozzles 36. These nozzles are tiltable along with the nozzles 38 through which the coal and primary air are introduced. This air is necessary for maintaining initial ignition and stable combustion conditions. The primary and secondary air constitutes about 20–30% of the total air required for complete or stoichiometric combustion of the coal.

Still looking at FIG. 2, positioned above and below each secondary air nozzle 36 are auxiliary, or tertiary air nozzles 40. The remainder of the air necessary for complete combustion, or stoichiometric conditions, is introduced through these nozzles 40. Generally about 70–80% of the stoichiometric air is introduced through auxiliary nozzles 40.

Figure 3:
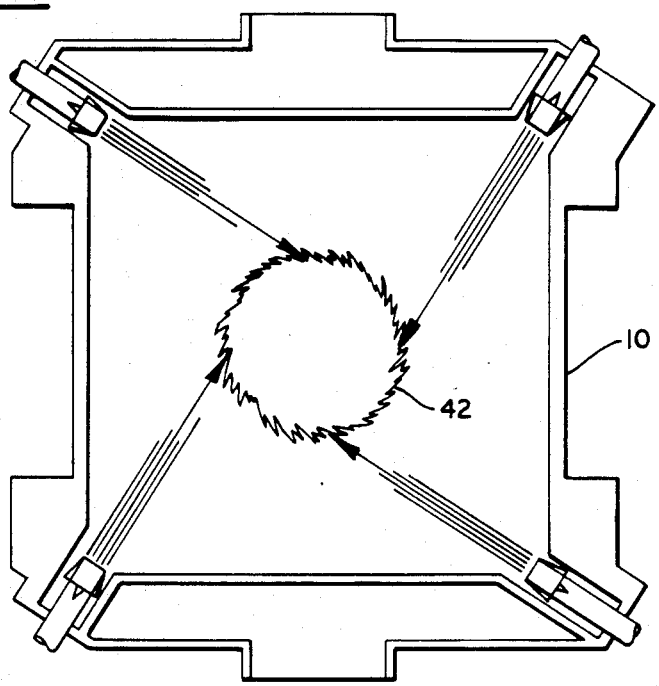
FIG. 3 is a view taken on line 3—3 of FIG. 1.
Figure 4:
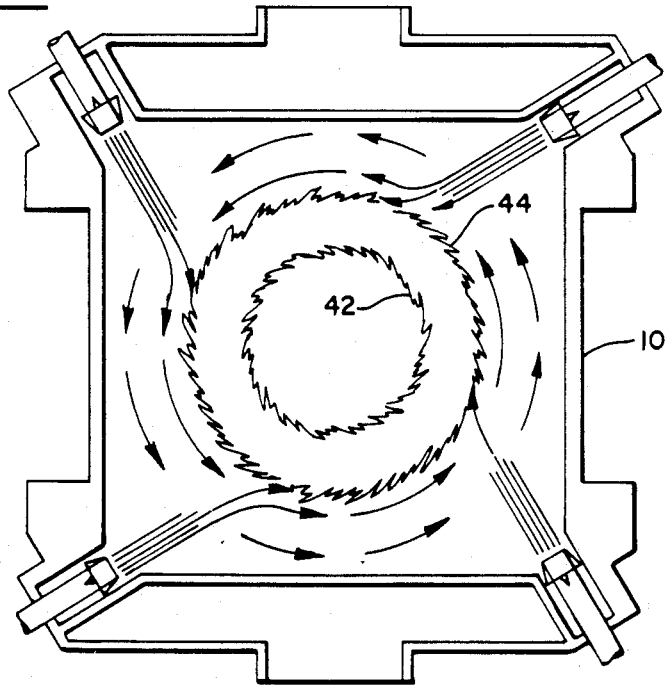
FIG. 4 is a view taken on line 4—4 of FIG. 1.

Looking now to FIGS. 3 and 4, the manner in which the coal and primary air, the secondary air, and the auxiliary air, is tangentially introduced into the furnace, is shown. As seen in FIG. 3, the coal and primary air along with the secondary air, are introduced into the furnace tangential to an imaginary circle 42 in the central portion of the furnace. Looking now to FIG. 4, it can be seen that the auxiliary air is introduced into the furnace tangential to an imaginary circle 44, at locations directly above and below the fire ball 42.The auxiliary air is introduced into the furnace rotating in a direction reverse, or opposite to the direction of rotation of the primary air and fuel. The result of this is a mixing and combustion efficiency much better than that realized with the usual tangentially fired furnace. This permits the use of less excess air in the furnace than previously required. The ultimate fire ball rising in the furnace rotates in a direction the same as that of the auxiliary air, since the mass introduced in this direction is several times that introduced in the opposite direction. The velocity of the auxiliary air is comparable to that of the primary and secondary air. The above feature, coupled with the fact that the auxiliary air is introduced tangential to a circle 44 larger than the circle 42, keeps a blanket of air adjacent to the furnace walls, thereby minimizing slagging on these walls.

Looking again at FIG. 1, all of the excess air is introduced into the furnace in the upper portion thereof. This excess, or overfire, air is introduced through nozzles 50, which are directed tangential to an imaginary circle 52, in a direction opposite to that of the rising fire ball; i.e opposite to the direction of introduction of the auxiliary 44. Since the amount of excess air is relatively small (5–20%), the flow leaving the furnace will still be swirling or rotating somewhat in the direction of rotation of the auxiliary air introduction. This causes some temperature unbalance the gases leaving the furnace. Some statistical data of the proposed modified furnace will now be given. The primary air and fuel are introduced into the unit at a 6° angle to the radial line from the vertical centerline axis of the furnace. The auxiliary air is introduced at a 5°–15° angle to the same vertical centerline of the furnace but opposite in direction. In this manner, the fuel and air are introducing swirl within the furnace in opposite directions. As stated previously, however, because of the greater mass and velocity of the auxiliary air, the ultimate overall swirl within the unit will be in the direction of the auxiliary air introduction. There can be as many as six elevations of burners; i.e. 24 in total, with six in each corner. These can be spread over a 30-foot height in the furnace beginning 50 feet above the opening in the coutant furnace bottom. The top wall of the furnace is approximately 100 feet above the top burner elevation, and the excess, or overfire, air is introduced about 60 feet above the top burner elevations.

We claim:

1. A method of operating a tangentially fired pulverized coal furnace for purposes of achieving a better mixing of the coal and auxiliary air so that the excess air required for complete combustion of the coal is kept to a minimum and so that the quantity of coal, burnt or unburnt, impacting the upper furnace walls is lowered thus reducing plugging and fouling in the furnace comprising the steps of:

a. discharging into the furnace at each of a plurality of first levels pulverized coal and primary air such that the pulverized coal and primary air being discharged at each of said plurality of first levels is directed in a first direction tangentially to a corresponding one of a plurality of first imaginary circles each located in the center of the furnace thereby causing a fireball to be formed within the furnace that rotates in said first direction while moving within the furnace;

b. discharging into the furnace at each of said plurality of first levels secondary air such that the secondary air being discharged at each of said plurality of first levels is directed in said first direction tangentially to each of a corresponding one of said plurality of first imaginary circles each located in the center of the furnace;

c. discharging into the furnace at each of a plurality of second levels that are each located directly above a corresponding one of each of said plurality of first levels auxiliary air in a mass more than two times that of the primary air such that the auxiliary air being discharged at each of said plurality of second levels unlike the pulverized coal and the primary air and the secondary air being discharged at each of said plurality of first levels is directed in a second direction that is opposite to said first direction tangentially to a corresponding one of a plurality of second imaginary circles each located in the center of the furnace thereby causing a fireball to be formed within the furnace that rotates in said second direction while moving upwardly within the furnace; and d. causing each fireball formed within the furnace to rotate in said second direction upon exiting from the furnace because of the influence exerted thereupon by virtue of the auxiliary air having a greater mass.

2. The method as set forth in claim 1 wherein the diameter of each of said plurality of second imaginary circles is greater than the diameter of each of said plurality of first imaginary circles thereby resulting in a protective blanket of air consisting of auxiliary air being provided adjacent to the inner walls of the furnace.

3. The method as set forth in claim 2 wherein the pulverized coal and the primary air are each discharged into the furnace at each of said plurality of first levels at an angle of 6° to the centerline of the furnace.

4. The method as set forth in claim 3 wherein the auxiliary air is discharged into the furnace at each of said plurality of second levels at an angle of 5° to 15° to the centerline of the furnace.

5. The method as set forth in in claim 4 including the further step of discharging into the furnace at a third level spaced a considerable distance from both any of said plurality of first levels and any of said plurality of second levels overfire air so that the overfire air like the pulverized coal and the primary air and the secondary air is directed in said first direction tangentially to a third imaginary circle located in the center of the furnace.

6. The method as set forth in claim 5 wherein the overfire air discharged into the furnace at said third level amounts to 5 to 20% excess air.

7. A method of operating a tangentially fired pulverized coal furnace for purposes of achieving a better mixing of the coal and auxiliary air so that the excess air required for complete combustion of the coal is kept to a minimum and so that the quantity of coal, burnt or unburnt, impacting the upper furance walls is lowered thus reducing plugging and fouling in the furnace comprising the steps of:

a. discharging into the furnace at each of a plurality of first levels pulverized coal and primary air such that the pulverized coal and primary air being discharged at each of said plurality of first levels is directed in a first direction tangentially to a corresponding one of a plurality of first imaginary circles each located in the center of the furnace thereby causing a fireball to be formed within the furnace that rotates in said first direction while moving within the furnace;

b. discharging into the furnace at each of a plurality of second levels that are each located directly above a corresponding one of each of said plurality of first levels auxiliary air in a mass more that two times that of the primary air such that the auxiliary air being discharged at each of said plurality of second levels unlike the pulverized coal and the primary air being discharged at each of said plurality of first levels is directed in a second direction that is opposite to said first direction tangentially to a corresponding one of a plurality of second imaginary circles each located in the center of the furnace thereby causing a fireball to be formed within the furnace that rotates in said second direction while moving upwardly within the furnace;

c. discharging into the furnace at a third level spaced a considerable distance from both any of said plurality of first levels and any of said plurality of second levels overfire air so that the overfire air like the pulverized coal and the primary air is directed in said first direction tangentially to a third imaginary circle located in the center of the furnace; and d. causing each fireball formed within the furnace to rotate in said second direction upon exiting from the furnace because of the influence exerted thereupon by virtue of the auxiliary air having a greater mass.

8. The method as set fourth in claim 7 wherein the diameter of each of said plurality of second imaginary circles is greater than the diameter of each of said plurality of first imaginary circles thereby resulting in a protective blanket of air consisting of auxiliary air being provided adjacent to the inner walls of the furnace.

9. The method as set forth in claim 8 wherein the pulverized coal and the primary air are each discharged into the furnace at each of said plurality of first levels at an angle of 6° to the centerline of the furnace.

10. The method as set forth in claim 9 wherein the auxiliary air is discharged into the furnace at each of said plurality of second levels at an angle of 5° to 15° to the centerline of the furnace.

11. The method as set forth in claim 10 wherein the overfire air discharged into the furnace at said third level amounts to 5 to 20% excess air.

* * * * *